US007452183B2

(12) United States Patent
Ruthemeyer et al.

(10) Patent No.: US 7,452,183 B2
(45) Date of Patent: Nov. 18, 2008

(54) THERMALLY COMPLIANT TURBINE SHROUD ASSEMBLY

(75) Inventors: Michael Anthony Ruthemeyer, Cincinnati, OH (US); Glenn Herbert Nichols, Mason, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 482 days.

(21) Appl. No.: 11/161,517

(22) Filed: Aug. 6, 2005

(65) Prior Publication Data

US 2007/0031244 A1 Feb. 8, 2007

(51) Int. Cl.
*F01D 11/08* (2006.01)

(52) U.S. Cl. ..... 415/135; 415/173.1

(58) Field of Classification Search ..... 415/134, 415/135, 136, 137, 173.1, 173.3, 174.2, 213.1; 277/647

See application file for complete search history.

(56) References Cited

U.S. PATENT DOCUMENTS

| | | | | |
|---|---|---|---|---|
| 3,860,358 | A * | 1/1975 | Cavicchi et al. | 415/173.1 |
| 6,354,795 | B1 | 3/2002 | White et al. | |
| 6,361,273 | B1 * | 3/2002 | Eng et al. | 415/173.1 |
| 2002/0048512 | A1 * | 4/2002 | Cot et al. | 415/173.1 |

* cited by examiner

*Primary Examiner*—Richard Edgar
(74) *Attorney, Agent, or Firm*—Adams Intellectual Property Law, P.A.; William Scott Andes, Esq.

(57) ABSTRACT

A shroud assembly is provided for a gas turbine engine having a temperature at a hot operating condition substantially greater than at a cold assembly condition thereof. The shroud assembly includes at least one arcuate shroud segment adapted to surround a row of rotating turbine blades. The shroud segment has an arcuate, axially extending mounting flange. A shroud hanger includes an arcuate, axially-extending hook. A dimension of one of the shroud segments and the shroud hanger are selected to produce a preselected dimensional relationship therebetween at the hot operating condition.

16 Claims, 6 Drawing Sheets

THERMALLY COMPLIANT TURBINE SHROUD ASSEMBLY

BACKGROUND OF THE INVENTION

This invention relates generally to gas turbine components, and more particularly to turbine shrouds and related hardware.

It is desirable to operate a gas turbine engine at high temperatures for efficiently generating and extracting energy from these gases. Certain components of a gas turbine engine, for example stationary shrouds segments and their supporting structures, are exposed to the heated stream of combustion gases. The shroud is constructed to withstand primary gas flow temperatures, but its supporting structures are not and must be protected therefrom. To do so, a positive pressure difference is maintained between the secondary flowpath and the primary flowpath. This is expressed as a back flow margin or "BFM". A positive BFM ensures that any leakage flow will move from the non-flowpath area to the flowpath and not in the other direction.

In prior art turbine designs, various arcuate features such as the above-mentioned shrouds, retainers, and supporting members are designed to have matching circumferential curvatures at their interfaces under cold (i.e. room temperature) assembly conditions. During hot engine operation condition, the shrouds and hangers heat up and expand according to their own temperature responses. Because the shroud temperature is much hotter than the hanger temperature and the shroud segment is sometimes smaller than the hanger segment or ring, the curvature of the shroud segment will expand more and differently from the hanger curvature at the interface under steady state, hot temperature operation conditions. In addition, there is more thermal gradient within the shroud than in the hanger, resulting in more deflection or cording of the shroud.

Because of these curvature differences between the shroud support rails and hanger support rails at the interface, a leakage gap is formed between the hanger support rail and the shroud support rail which can cause excessive leakage of cooling air at the shroud trailing edge and lower the BFM at the shroud leading edge, significantly increasing the risk of localized ingestion of hot flow path gases. These curvature deviations also can create stresses on the shroud at the hot temperature condition, lowering the life of the shroud.

Accordingly, there is a need for a shroud design that can reduce the curvature deviation between the shroud support rail and the hanger support rail at the hot operation condition, minimizing the risk of adverse impact to both shroud and hanger durability.

BRIEF SUMMARY OF THE INVENTION

The above-mentioned need is met by the present invention, which according to one aspect provides a shroud assembly for a gas turbine engine having a temperature at a hot operating condition substantially greater than at a cold assembly condition thereof, the shroud assembly including: at least one arcuate shroud segment adapted to surround a row of rotating turbine blades, the shroud segment having an arcuate, axially extending mounting flange; and a shroud hanger having an arcuate, axially-extending hook disposed in mating relationship to the mounting flange. A dimension of one of the shroud segment and the shroud are selected to produce a matching interface therebetween at hot operating condition.

According to another aspect of the invention, a method of constructing a shroud assembly for a gas turbine engine includes: providing at least one arcuate shroud segment adapted to surround a row of rotating turbine blades, the shroud segment having an arcuate, axially extending mounting flange having a first cold curvature at an ambient temperature, and a first hot curvature at an operating temperature substantially greater than the ambient temperature; providing a shroud hanger having an arcuate, axially-extending hook having a second cold curvature at the ambient temperature and a second hot curvature at the operating temperature, the hook disposed in mating relationship to the mounting flange; and selecting the first and second cold curvatures such that the first and second hot curvatures define a matching interface between the shroud segment and the shroud hanger.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
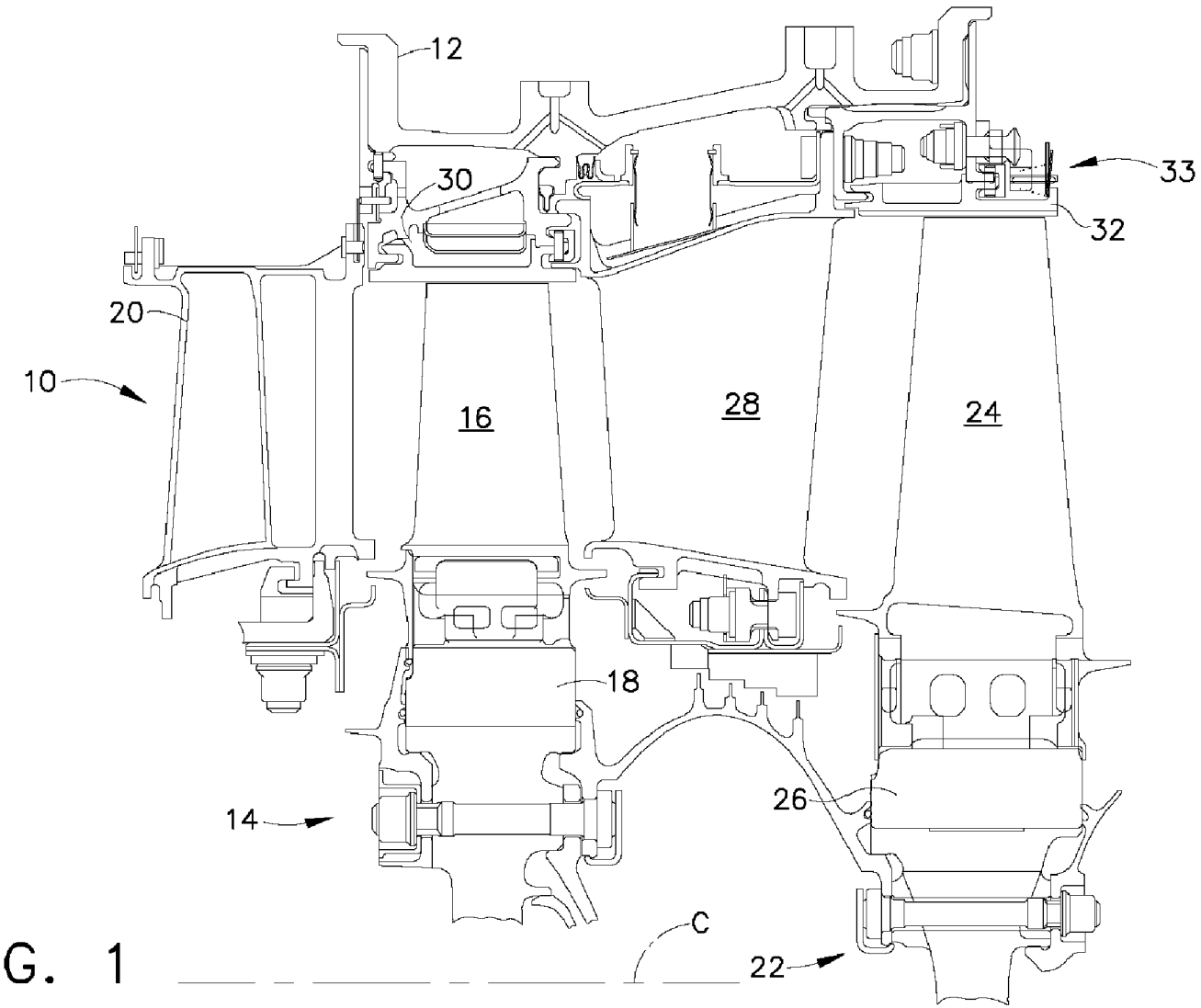
FIG. 1 is a cross-sectional view of an exemplary high-pressure turbine section incorporating the shroud assembly of the present invention.

Referring to the drawings wherein identical reference numerals denote the same elements throughout the various views, FIG. 1 illustrates a portion of a high-pressure turbine (HPT) 10 of a gas turbine engine. the HPT 10 includes a number of turbine stages disposed within an engine casing 12. As shown in FIG. 1, the HPT 10 has two stages, although different numbers of stages are possible. The first turbine stage includes a first stage rotor 14 with a plurality of circumferentially spaced-apart first stage blades 16 extending radially outwardly from a first stage disk 18 that rotates about the centerline axis "C" of the engine, and a stationary first stage turbine nozzle 20 for channeling combustion gases into the first stage rotor 14. The second turbine stage includes a second stage rotor 22 with a plurality of circumferentially spaced-apart second stage blades 24 extending radially outwardly from a second stage disk 26 that rotates about the centerline axis of the engine, and a stationary second stage nozzle 28 for channeling combustion gases into the second stage rotor 22. A plurality of arcuate first stage shroud segments 30 are arranged circumferentially in an annular array so as to closely surround the first stage blades 16 and thereby define the outer radial flowpath boundary for the hot combustion gases flowing through the first stage rotor 14.

A plurality of arcuate second stage shroud segments 32 are arranged circumferentially in an annular array so as to closely surround the second stage blades 24 and thereby define the outer radial flowpath boundary for the hot combustion gases flowing through the second stage rotor 22. The shroud segments 32 and their supporting hardware are referred to herein as a "shroud assembly" 33.

Figure 2:
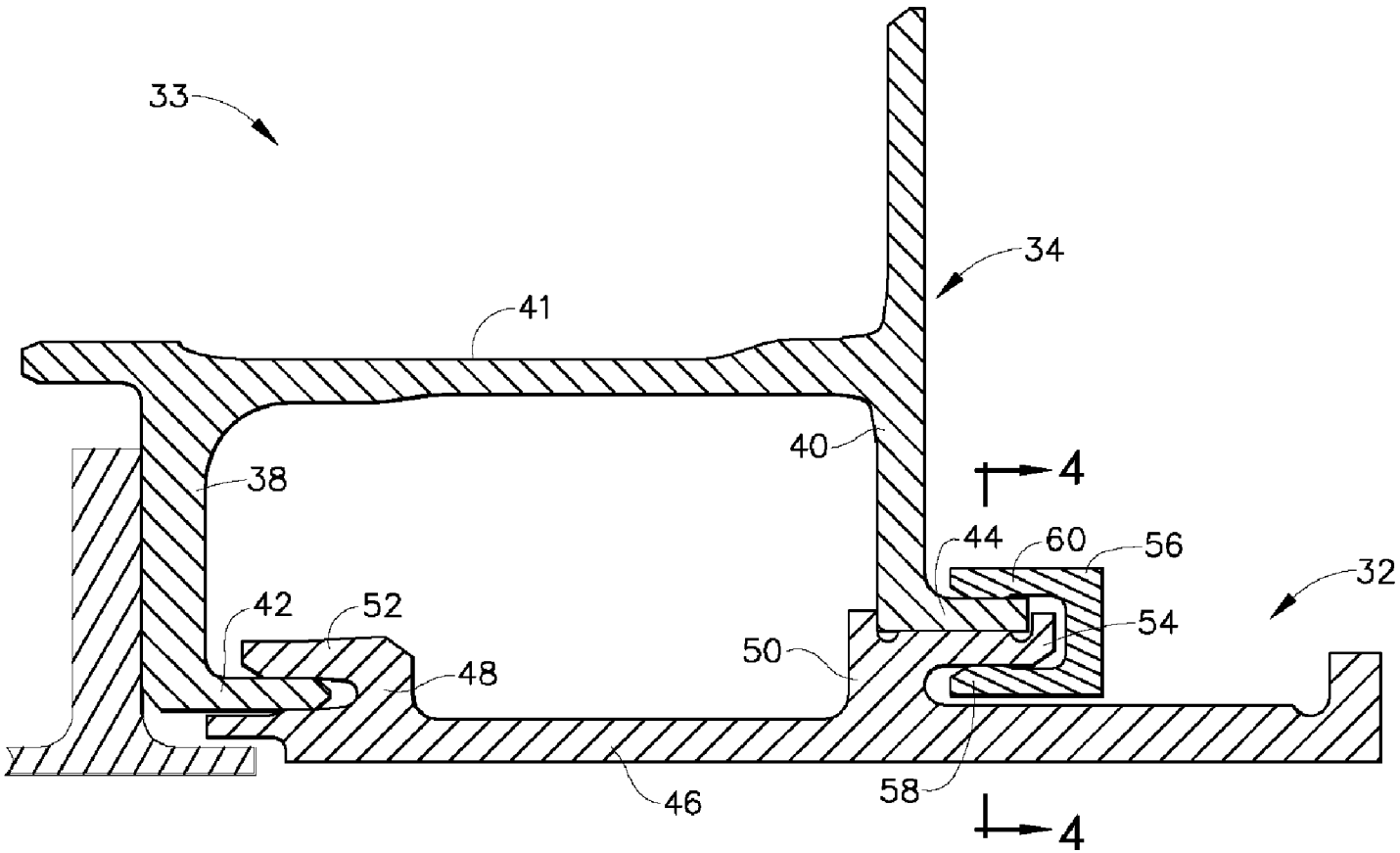
FIG. 2 is an enlarged view of a portion of the turbine section of FIG. 1.

FIG. 2 illustrates the prior art shroud assembly 33 in more detail. A supporting structure referred to as a "shroud hanger" 34 is mounted to the engine casing 12 (see FIG. 1) and retains the second stage shroud segment 32 to the casing 12. The shroud hanger 34 is generally arcuate and has spaced-apart forward and aft radially-extending arms 38 and 40, respectively, connected by a longitudinal member 41. The shroud hanger 34 may be a single continuous 360° component, or it may be segmented into two or more arcuate segments. An arcuate forward hook 42 extends axially aft from the forward arm 38, and an arcuate aft hook 44 extends axially aft from the aft arm 40.

Each shroud segment 32 includes an arcuate base 46 having radially outwardly extending forward and aft rails 48 and 50, respectively. A forward mounting flange 52 extends forwardly from the forward rail 48 of each shroud segment 32, and an aft mounting flange 54 extends rearwardly from the aft rail 50 of each shroud segment 32. The shroud segment 32 may be formed as a one-piece casting of a suitable superalloy, such as a nickel-based superalloy, which has acceptable strength at the elevated temperatures of operation in a gas turbine engine. The forward mounting flange 52 engages the forward hook 42 of the shroud hanger 34. The aft mounting flange 54 of each shroud segment 32 is juxtaposed with the aft hook 44 of the shroud hanger 34 and is held in place by a plurality of retaining members commonly referred to as "C-clips" 56.

The C-clips 56 are arcuate members each having a C-shaped cross section with inner and outer arms 58 and 60, respectively, that snugly overlap the aft mounting flanges 54 and the aft hooks 44 so as to clamp the aft ends of the shroud segments 32 in place against the shroud hangers 34. Although they could be formed as a single continuous ring, the C-clips 56 are typically segmented to accommodate thermal expansion. Typically, one C-clip 56 clamps an entire shroud plus one-half of each adjacent shroud. In this case, there are twice as many shroud segments 32 as there are C-clips 56.

Figure 3:
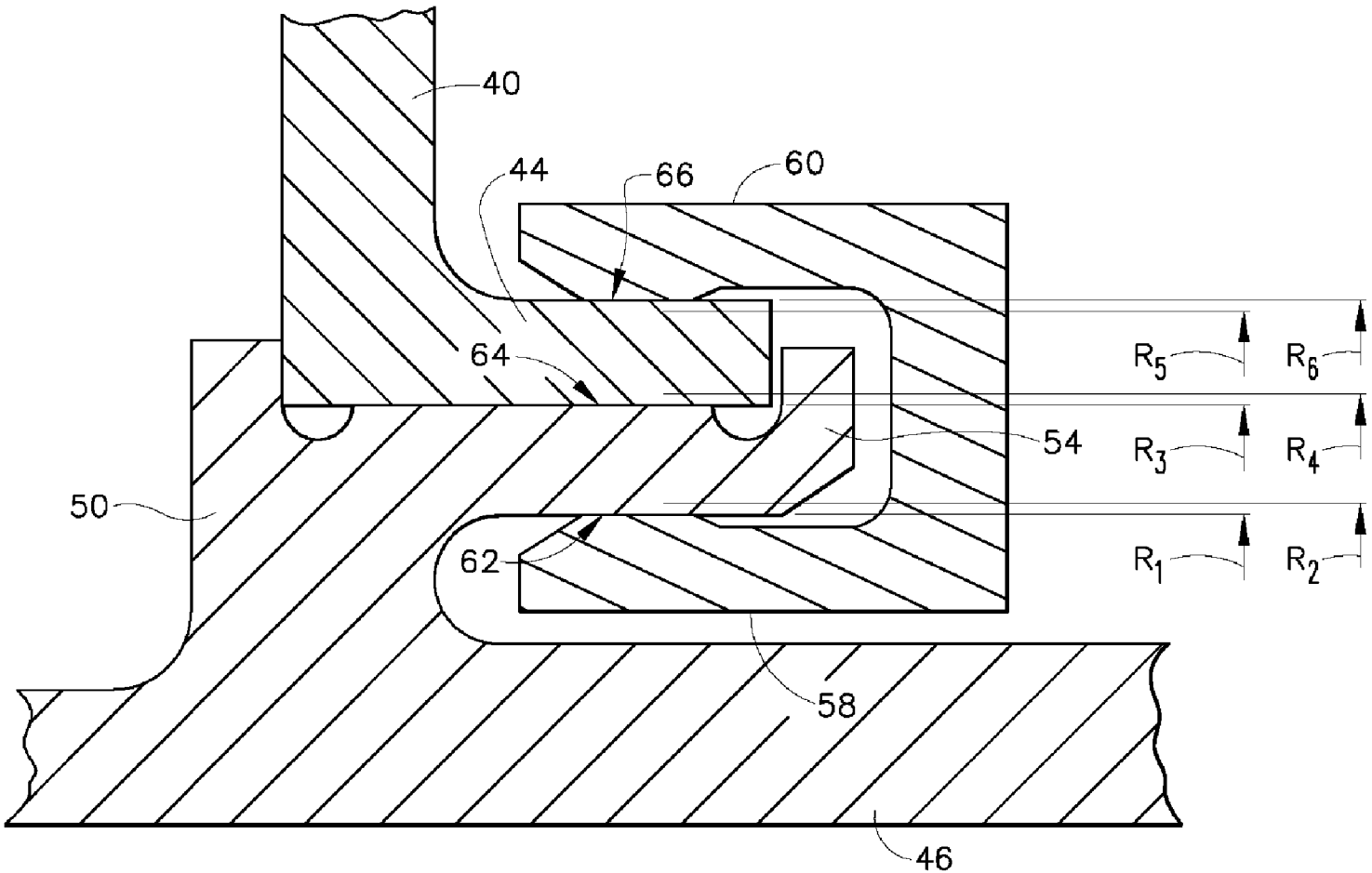
FIG. 3 is an enlarged cross-sectional view of a portion of FIG. 2.

FIG. 3 is an enlarged view of the aft portion of the shroud segment 32, showing the radii of various components. "R1" is the outside radius of the inner arm 58 of the C-clip 56. "R2" is the inside radius of the aft mounting flange 54 of the shroud segment 32, and "R3" is its outside radius. "R4" is the inside radius of the aft hook 44 of the shroud hanger 34, and "R5" is its outside radius. Finally, "R6" is the inside radius of the outer arm 60 of the C-clip 56. These radii define interfaces 62, 64, and 66 between the various components. For example, the radii "R1" of the lower C-clip arm 58 and "R2" of the aft mounting flange 54 meet at the interface 62.

Figure 4A:
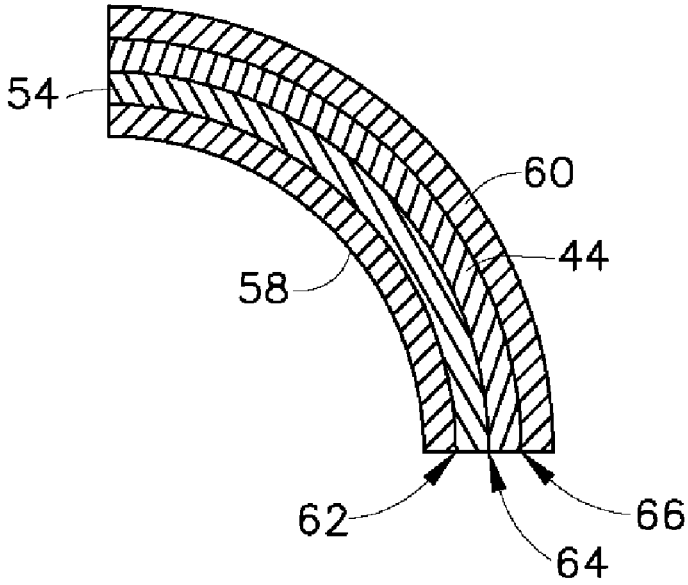
FIG. 4A (PRIOR ART)
FIG. 4A is partial cross-sectional view taken along lines 4-4 of FIG. 2.

FIG. 4A shows the relationship of the curvatures of these interfaces 62, 64, and 66 at a cold (i.e. room temperature) assembly condition. The curvatures are designed to result in a preselected dimensional relationship at this condition. The term "preselected dimensional relationship" as used herein means that a particular intended relationship between components applies more or less consistently at the interface, whether that relationship be a specified radial gap, a "matched interface" where the gap between components is nominally zero, or a specified amount of radial interference. For example, in FIG. 4A, there is a preselected amount of radial interference at each point around the circumference of the interfaces 62 and 66, in order to provide a predetermined clamping force to the aft mounting flange 54 and the aft hook 44, in accordance with known engineering principles. The interface 64 is a "matched interface" in that radius R3 is equal to radius R4. It should be noted that the term "curvature" is used to refer to deviation from a straight line, and that the magnitude of curvature is inversely proportional to the circular radius of a component or feature thereof.

Figure 4B:
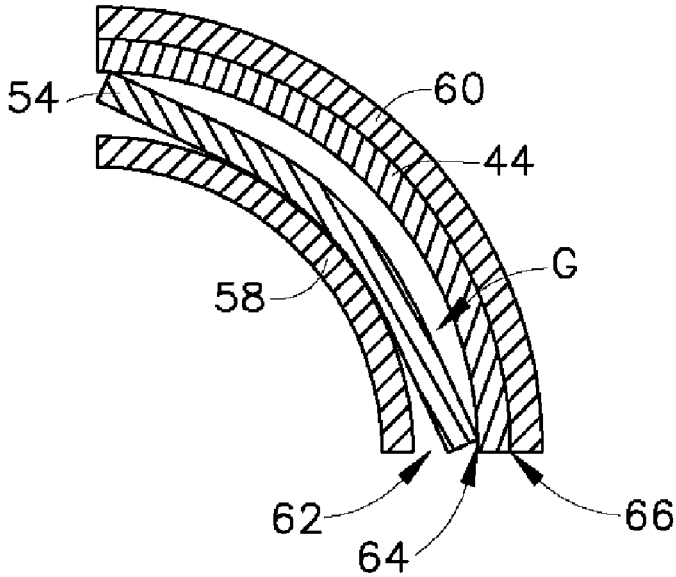
FIG. 4B (PRIOR ART)
FIG. 4B is partial cross-sectional view taken along lines 4-4 of FIG. 2.

FIG. 4B illustrates the changes of the interfaces 62, 64, and 66 from a cold assembly condition to a hot engine operation condition. At operating temperatures, for example bulk material temperatures of about 538° C. (1000° F.) to about 982° C. (1800° F.), all of the shroud segment 32, shroud hanger 34, and C-clip 56 will heat up and expand according to their own temperature responses. Because the shroud temperature is much hotter than the hanger temperature and the shroud segment 32 is much smaller than the hanger segment or ring, the curvature of the shroud segment 32 will expand more and differently from the hanger curvature at the interface 64 under steady state, hot temperature operation conditions. In addition, there is more thermal gradient within the shroud segment 32 than in the hanger. As a result, the shroud segment 32 and its aft mounting flange 54 will tend to expand and increase its radius into a flattened shape (a phenomenon referred to as "cording") to a much greater degree than either the C-clip 56 or the aft hook 44. This causes a gap "G" to be formed at the interface 64 between the shroud aft mounting flange outer radius and the shroud hanger aft hook inner radius. This gap G can permit excessive leakage and lower the available BFM, possibly even to the point at which hot gas is ingested into the non-flow path region.

Figure 5:
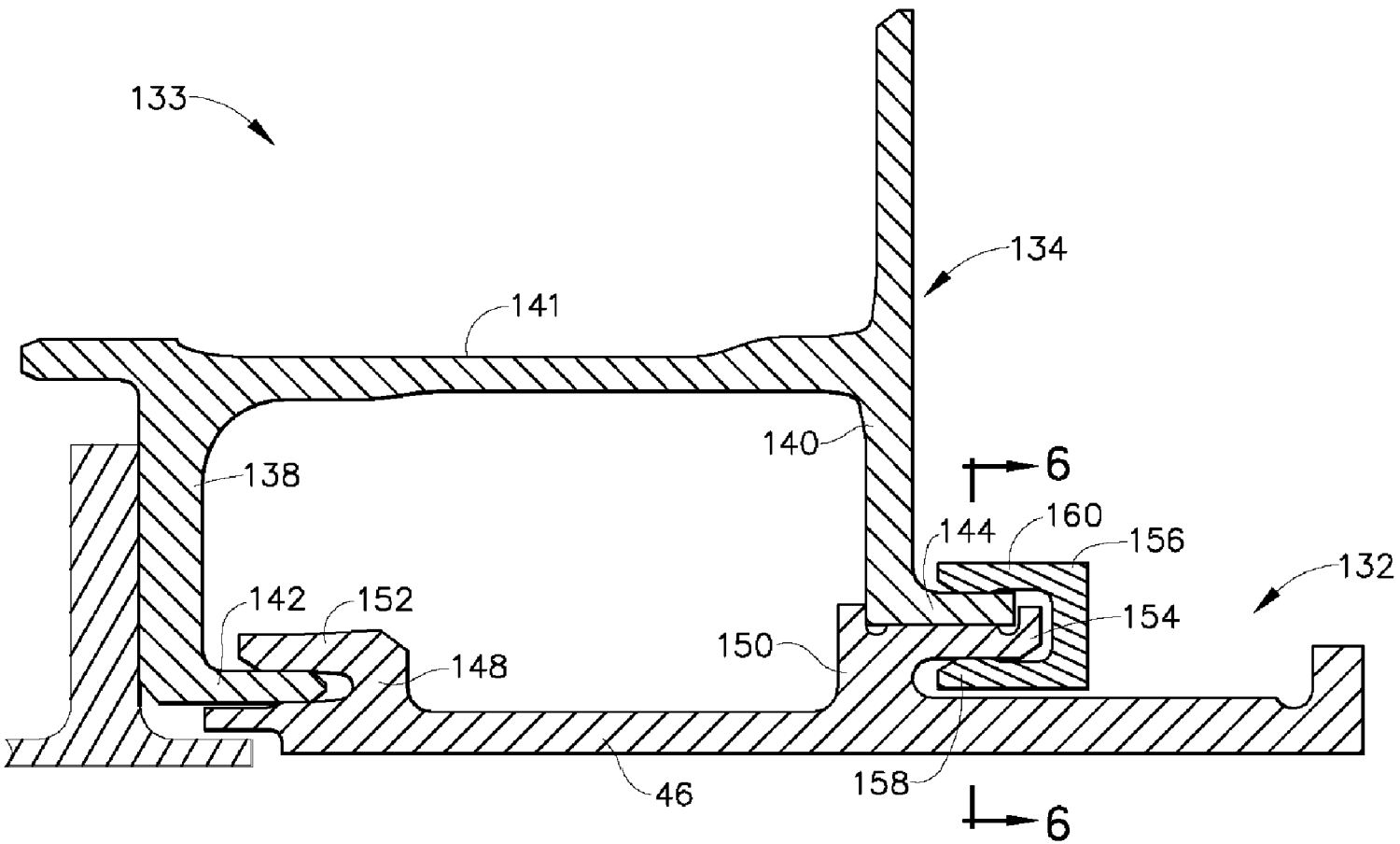
FIG. 5 is a cross-sectional view of a shroud assembly constructed according to the present invention.

FIG. 5 illustrates a shroud assembly 133 constructed according to the present invention. The shroud assembly 133 is substantially identical in most aspects to the prior art shroud assembly 33 and includes a "shroud hanger" 134 with spaced-apart forward and aft radially-extending arms 138 and 140, respectively, connected by a longitudinal member 141, and arcuate forward and aft hooks 142 and 144. A shroud segment 132 includes an arcuate base 146 with forward and aft rails 148 and 150, carrying forward and aft mounting flanges 152 and 154, respectively. The forward mounting flange 152 engages the forward hook 142 of the shroud hanger 134. The shroud segment 132 is held in place by a plurality of "C-clips" 156 each having inner and outer arms 158 and 160, respectively.

The shroud assembly 133 differs from the shroud assembly 33 primarily in the selection of certain dimensions of the shroud segment 132, shroud hanger 134, and C-clips 156 which affect the interfaces 162, 164, and 166 (see FIGS. 6A and 6B)between these components.

Figure 6A:
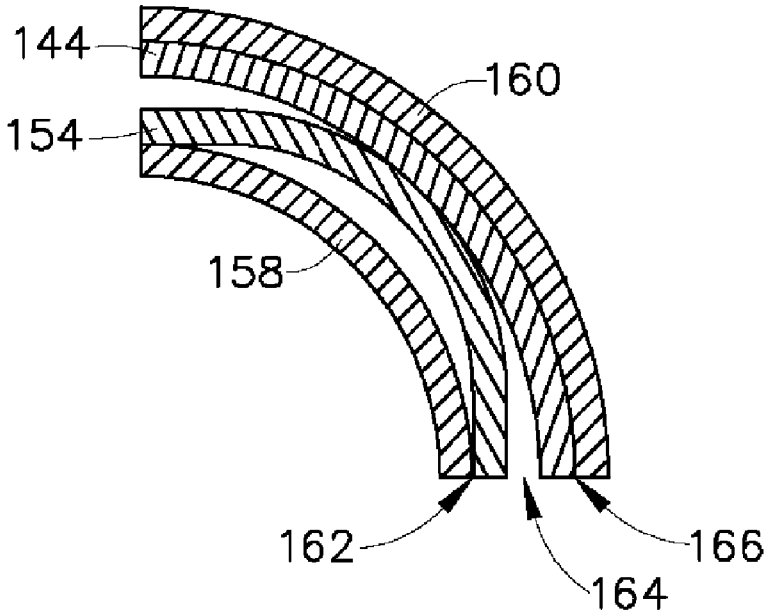
FIG. 6A is partial cross-sectional view taken along lines 6-6 of FIG. 5.

FIG. 6A shows the relationship of the curvatures of these interfaces 162, 164, and 166 at a cold (i.e. ambient environmental temperature) assembly condition, also referred to as their "cold curvatures". The "hot" curvatures of the interfaces are selected to achieve a preselected dimensional relationship at the anticipated hot engine operating condition, meaning that they are intentionally "mismatched" or "corrected" at the cold assembly condition based on each component's thermal growth differences. Specifically, the curvature of the outer surface of the shroud aft mounting flange 154 is greater than the curvature of the hanger aft hook 144 at the cold condition.

Figure 6B:
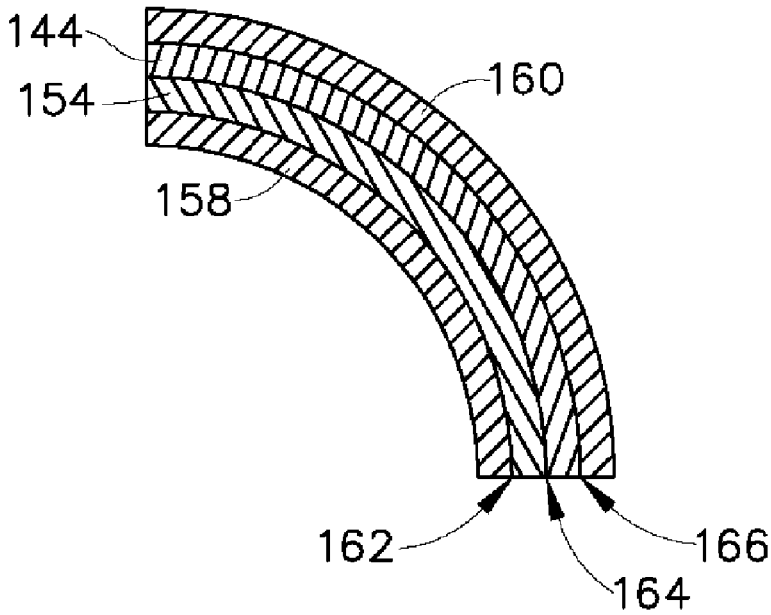
FIG. 6B is partial cross-sectional view taken along lines 6-6 of FIG. 5

At operating temperatures, for example bulk material temperatures of about 538° C. (1000° F.) to about 982° C. (1800° F.), the shroud segment 132 and its aft mounting flange 154 will be hotter and expand more than the shroud hanger aft hook 144, resulting in an interface 164 therebetween that is closer to being "matched" than in the prior art. As noted above, the term "matched interface" as used herein means that the gap between components is nominally zero, The principles described herein could also be used for other kinds of dimensional relationships. For example, the preselected dimensional relationship could be a specified radial gap, or a specified amount of radial interference. As shown in FIG. 6B, the more matched interface 164, will substantially reduce or eliminate the gap "G" seen in FIG. 4B, thus forming a better seal and lowering the leakage flow at the most prevalent engine operating condition. This is especially important in industrial, high-time-at-high-temperature engines such as those used in marine and industrial applications.

The correction may be accomplished by different methods. In any case, a suitable means of modeling the high-temperature behavior of the shroud assembly 133 is used to simulate the dimensional changes in the components as they heat to the hot operating condition. The cold dimensions of the components are then set so that the appropriate "stack-up" or dimensional interrelationships will be obtained at the hot operating condition.

The desired hot stack-up may be achieved through simple intentional mis-matching of components. For example, in the illustrated shroud assembly 133 having a shroud hanger 134 with "baseline" dimensions, the C-clip 156 and the shroud segment 132 may use components which are intended for use with a different engine that have circular radii slightly smaller than those components ordinarily would. For example, in a shroud assembly where the outside radius of the shroud mounting flange 154 is intended to be equal to the inside radius of the shroud aft hook 144, and both of these dimensions are approximately 44.5 cm (17.5 inches) at a cold assembly condition, a decrease of about 2 to about 3 inches in the outside radius of the shroud mounting flange 154 would be considered an optimum amount of "correction". This would theoretically cause the outside radius of the shroud mounting flange 154 to be equal to the inside radius of the shroud aft hook 144 at the hot operating condition. This result is what is depicted in FIG. 6B.

In actual practice, a balance must be struck between obtaining the preselected dimensional relationship to the desired degree at the hot operating condition, and managing the difficulty in assembly caused by component mismatch at the cold assembly condition. The component stresses must also be kept within acceptable limits at the cold assembly condition. In the illustrated example, the outside radius of the shroud mounting flange 154 is about 1.02 mm (0.040 in. ) to about 1.27 mm (0.050 in.) less than the inside radius of the shroud aft hook 144 at the cold operating condition. This amount of correction does not completely eliminate the gap "G" described above, but has been found to be beneficial. Stated another way, the "preselected dimensional relationship" in this example would be that the gap "G" is reduced in size relative to the prior art.

Alternatively, purpose-designed components may be used. For example, the shroud hanger aft hook 144 may be constructed so that its curvature is less than the curvature of the shroud aft mounting flange 154 at the cold condition. This would result in the same relative "stack-up" of the interface 164 as shown in FIG. 6A. The desired high-temperature interface matching could also be accomplished by modifying both the shroud hanger 134 and the shroud segment 132 to some degree.

It has been found analytically that the above-described configuration and assembly method can result in a substantial reduction in trailing edge hook leakage flow and improves shroud back-flow-margin. The matched interfaces also result in a reduction in C-clip stress, a reduction in shroud stress and reduced C-clip distortion at the hot engine operation condition.

The foregoing has described a shroud assembly for a gas turbine engine. While specific embodiments of the present invention have been described, it will be apparent to those skilled in the art that various modifications thereto can be made without departing from the spirit and scope of the invention. For example, while the present invention is described above in detail with respect to a second stage shroud assembly, a similar structure could be incorporated into other parts of the turbine. Accordingly, the foregoing description of the preferred embodiment of the invention and the best mode for practicing the invention are provided for the purpose of illustration only and not for the purpose of limitation, the invention being defined by the claims.

What is claimed is:

1. A shroud assembly for a gas turbine engine having a temperature at a hot operating condition substantially greater than at a cold assembly condition thereof, said shroud assembly comprising:

at least one arcuate shroud segment adapted to surround a row of rotating turbine blades, said shroud segment having an arcuate, axially extending mounting flange; and a shroud hanger having an arcuate, axially-extending hook disposed in mating relationship to said mounting flange;

wherein the mating relationship is disposed at a medial location of said flange and said hook at the cold assembly condition, said mounting flange and said hook define a radial gap therebetween positioned circumferentially away from the mating relationship at the cold assembly condition, said shroud hanger and said shroud segment are subject to thermal expansion at said hot operating condition, and a dimension of one of said shroud segment and said shroud hanger are selected to produce a preselected dimensional relationship therebetween at said hot operating condition.

2. The shroud assembly of claim 1 wherein said preselected dimensional relationship comprises a preselected amount of radial interference between mating portions of said hook and said mounting flange.

3. The shroud assembly of claim 1 wherein said preselected dimensional relationship comprises a matched interface between mating portions of said hook and said mounting flange.

4. The shroud assembly of claim 1 wherein said preselected dimensional relationship comprises a preselected radial gap between said hook and said mounting flange.

5. The shroud assembly of claim 1 further comprising an arcuate C-clip having inner and outer arms overlapping said hook and said mounting flange.

6. The shroud assembly of claim 5 wherein said hook has a first radius of curvature; and at least one of said inner and outer arms of said C-clip has a second radius of curvature which is substantially less than said first radius of curvature.

7. The shroud assembly of claim 6 wherein said first mounting flange has a second radius of curvature which is substantially less than said first radius of curvature.

8. The shroud assembly of claim 1 wherein said hook has a first radius of curvature; and said mounting flange has a second radius of curvature which is substantially less than said first radius of curvature.

9. A method of constructing a shroud assembly for a gas turbine engine comprising:

providing at least one arcuate shroud segment adapted to surround a row of rotating turbine blades, said shroud segment having an arcuate, axially extending mounting flange having a first cold curvature at an ambient temperature, and a first hot curvature at an operating temperature substantially greater than said ambient temperature;

providing a shroud hanger having an arcuate, axially-extending hook having a second cold curvature at said ambient temperature and a second hot curvature at said operating temperature, said hook disposed in mating relationship to said mounting flange;

selecting said first and second cold curvatures such that said first and second hot curvatures define a preselected dimensional relationship between said shroud segment and said shroud hanger and the mating relationship is disposed at a medial location of said flange and said hook at the cold assembly condition, said mounting flange and said hook define a radial gap therebetween positioned circumferentially away from the mating relationship at the cold assembly condition.

10. The method of claim 9 wherein said preselected dimensional relationship comprises a preselected amount of radial interference between mating portions of said hook and said mounting flange.

11. The method of claim 9 wherein said preselected dimensional relationship comprises a matching interface between mating portions of said hook and said mounting flange.

12. The method of claim 9 wherein said preselected dimensional relationship comprises a preselected radial gap between mating portions of said hook and said mounting flange.

13. The method of claim 9 further comprising providing an arcuate C-clip having inner and outer arms overlapping said hook and said mounting flange.

14. The method of claim 13 wherein said hook has a first radius of curvature; and at least one of said inner and outer arms of said C-clip has a second radius of curvature which is substantially less than said first radius of curvature.

15. The method of claim 14 wherein said hook has a first radius of curvature; and said mounting flange has a second radius of curvature which is substantially less than said first radius of curvature.

16. The shroud assembly of claim 9 wherein said hook has a first radius of curvature; and said mounting flange has a second radius of curvature which is substantially less than said first radius of curvature.

* * * * *